United States Patent [19]

Petrenchik

[11] 4,043,385

[45] Aug. 23, 1977

[54] MOLDING APPARATUS

[75] Inventor: John R. Petrenchik, Pepper Pike, Ohio

[73] Assignee: Mercury Machine Co., Warrensville Heights, Ohio

[21] Appl. No.: 716,672

[22] Filed: Aug. 23, 1976

[51] Int. Cl.[2] ..... B22D 17/26

[52] U.S. Cl. ..... 164/342; 249/161; 425/451; 425/451.4; 425/DIG. 5; 425/DIG. 58

[58] Field of Search ..... 249/161, 162; 425/242 R, 423, 441, 451, 451.4, DIG. 5, DIG. 58; 164/342, 343

[56] References Cited

U.S. PATENT DOCUMENTS

| | | | |
|---|---|---|---|
| 1,598,910 | 9/1926 | Haynes | 249/161 X |
| 1,971,849 | 8/1934 | Brundoge | 425/441 X |
| 2,711,567 | 6/1955 | Knopp | 249/161 X |
| 2,891,283 | 6/1959 | Cramer et al. | 425/DIG. 58 |
| 3,334,380 | 8/1967 | Di Settembrini | 425/451 X |
| 3,679,339 | 7/1972 | Jucker | 425/441 UX |
| 3,737,271 | 6/1973 | Novak | 425/441 X |
| 3,840,317 | 10/1974 | Koch et al. | 249/161 X |

*Primary Examiner*—Ronald J. Shore
*Attorney, Agent, or Firm*—Daniel G. Blackhurst

[57] ABSTRACT

The specification and drawings disclose an apparatus for permitting molding of components such as turbine blade assemblies and the like without the use of complex multipart molds. The disclosed apparatus comprises first and second mold halves carried by cooperating platens for relative movement toward and away from one another along a path. A connecting assembly is provided for attaching the first mold half to its respective platen in a manner which permits it to have free movement in directions perpendicular to the path and rotary movement about an axis parallel to the path. Additionally, a control assembly is provided to cause the first mold half to undergo predetermined transverse and rotary movement during movement along the path toward and away from the second mold half.

9 Claims, 9 Drawing Figures

MOLDING APPARATUS

BACKGROUND OF THE INVENTION

The subject invention is directed toward the art of casting or molding and, more particularly, to an apparatus for mounting a pair of mold halves in a manner which permits molding of complex shapes which could previously be molded only by the use of complex multipart molds.

The invention is especially suited for molding turbine or fan blade assemblies and/or lost wax patterns for the same and will be described with reference thereto; however, as will become apparent, the invention is capable of broader application and could be used for producing other somewhat similar parts.

The manufacture of turbine and fan blade assemblies by casting typically requires complex lost wax patterns for the components themselves, or their cores. In the past, these patterns have been formed using complex multipart molds which required an extremely large amount of time-consuming manual assembly and disassembly. Alternatively, the patterns were molded in small sections and then laboriously joined to form the completed pattern.

As a result of the above, the production of the patterns has been time consuming and comparatively costly. Also, in the assembly technique, problems have been encountered in maintaining the required tolerances and uniformity of shape.

BRIEF DESCRIPTION OF THE INVENTION

The subject invention overcomes the above-discussed problems and permits molding of comparatively complex patterns while using simple mold designs. In particular, according to the invention a pair of cooperating mold halves are mounted such that at least one of the mold halves is permitted to have both translatory and rotary movement relative to the path of opening and closing movement. Also, control means are associated with the mold halves such that the translatory and rotary movement is programmed to occur in a predetermined relationship with the opening and closing movement.

As a consequence, the provision of the controlled, complex movement of the mold halves alows the formation of complex part configurations with undercuts and reverse surfaces. This can be accomplished with comparatively simple mold halves or very few, loose parts. The complexity of the mold havles, while reduced as compared to the prior techniques, does depend upon the configuration of the pattern being formed.

In accordance with a more specific aspect of the invention, the upper of a pair of vertically-separable mold halves is connected to a vertically-movable platen by a connecting assembly which permits the upper platen to have free transverse movement in horizontal planes and rotary movement about a vertical axis. The control means preferably comprising a simple mechanical cam assembly designed to produce a predetermined pattern of transverse and rotary movement coordinated with the vertical separating movement. Thus, as will subsequently be explained and described more fully, patterns for turbine and fan blade assemblies with their air-foiled shaped components can be formed from mold halves with few, if any, loose parts.

OBJECTS OF THE INVENTION

Accordingly, a primary object of the invention is the provision of an apparatus which simplifies molding of complex parts by permitting mold separation to take place along a controlled, non-linear path.

Another object is the provision of an apparatus of the type described wherein movement of the mold halves can be controlled to allow separation of molds which have negative draft.

A still further object is the provision of an apparatus of the type described which is comparatively simple to construct and operate and which permits substantial savings in the formation of complex moldings.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
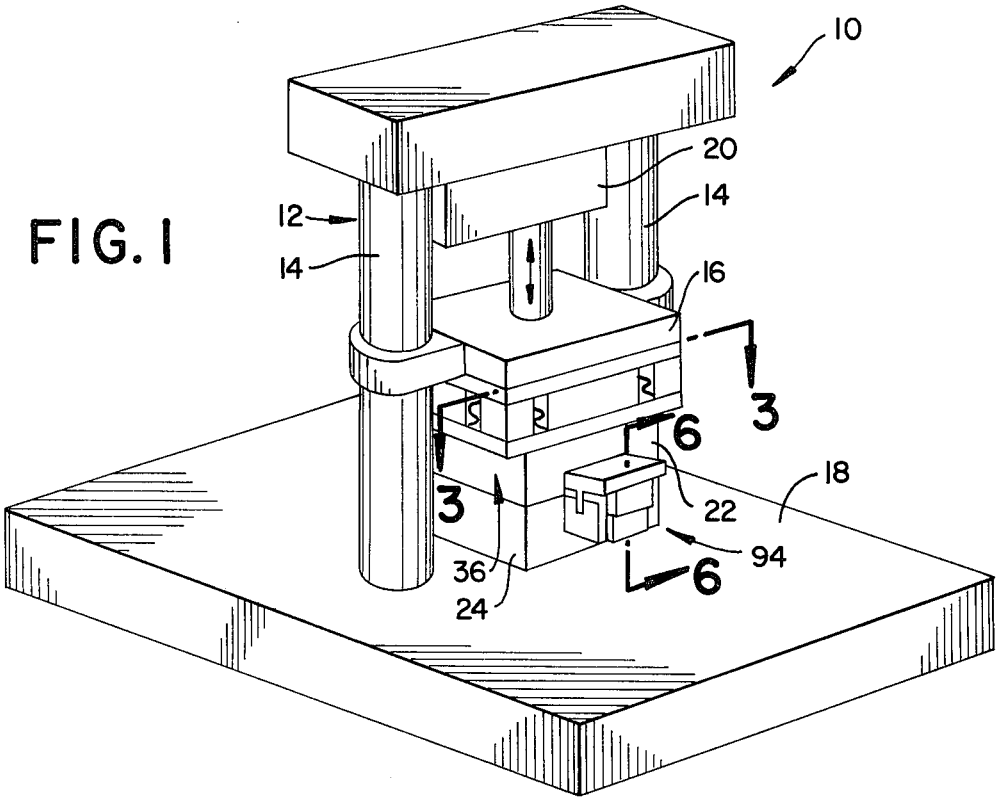
FIG. 1 is a diagrammatic view showing the general arrangement of a molding press incorporating apparatus formed in accordance with a preferred embodiment of the invention.

Referring more particularly to the drawings wherein the showings are for the purpose of illustrating a preferred embodiment of the invention only, and not for the purpose of limiting same, FIG. 1 illustrates, in somewhat schematic form, a molding press 10 which includes a frame 12 including a pair of vertically-extending tie members 14 which carry an upper platen 16 mounted for guided reciprocation toward and away from a fixed lower platen 18. Any convenient form of power actuating means 20 can be provided for producing movement of the upper platen 16.

Carried by the upper and lower platens 16, 18, respectively, are a pair of mating mold halves 22, 24 which cooperate to define a mold chamber having an internal configuration suitable to form a desired part. While the mold halves are in the closed position shown, the material from which the part is to be formed is injected into the mold chamber by apparatus not shown. Thereafter, the mold halves are separated and the formed part is removed.

The apparatus thus far described is conventionally well known. However, as discussed earlier, when forming certain parts which could not be designed with the required draft angles, the molds became extremely complex with many parts and sections which had to be manually assembled in and removed from the main mold halves before the halves could be closed or a finished part removed.

Figure 2A:
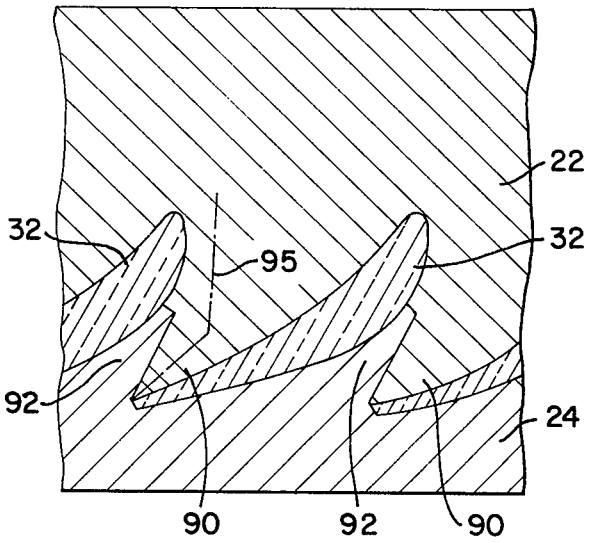
FIG. 2A is a partial cross-sectional view through dies capable of forming the part of FIG. 2.
Figure 2:
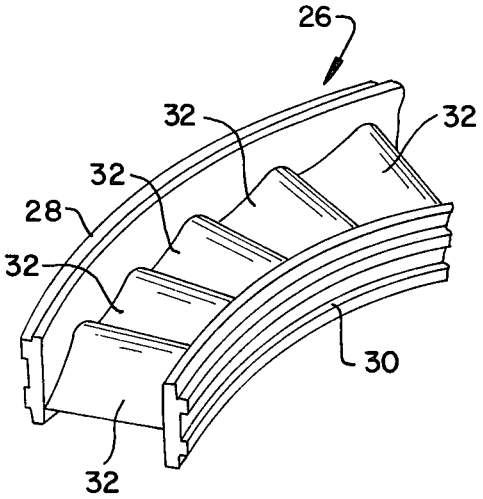
FIG. 2 is a pictorial view of a typical turbine blade core pattern which can be molded using the subject invention.

A typical part which required the complex molds is shown in FIG. 2. This part, which is illustrated merely for the purpose of explanation, is a wax or resin pattern 26 of the type required for forming turbine blade sections by the lost wax molding process. As shown, the pattern 26 comprises arcuate segments 28 and 30 which are joined by a plurality of blade members 32 each having an air-foil shape. As can be appreciated, because of the blades' air-foil shapes and their inclined, overlapping arrangement, the molds had to be formed with multiple, removable sections in the spaces between the blades. As a consequence, the molds were extremely expensive and required a large amount of manual assembly and disassembly. Alternatively, the patterns were molded as individual blades and manually joined to the required section configuration.

The subject invention provides an apparatus by which parts of the type referred to above can be formed comparatively simply with molds of substantially-reduced complexity. Specifically, the invention provides means whereby at least one of the mold halves can have freedom of movement in a plane perpendicular to the path of opening and closing movement. By controlling movement in this plane, it is possible to separate the mold halves along an irregular, non-linear path thereby obviating the need, in many instances, for standard draft angles.

The preferred apparatus embodying the invention is best shown in FIGS. 1 and 3–5. Specifically, the apparatus comprises an intermediate connecting assembly 36 positioned between the upper platen 16 and the upper mold half 22. The assembly 36 is arranged to connect the mold half 22 to the upper platen 16 while permitting it to have two direction freedom of movements in planes perpendicular to the path of mold opening. In addition, it permits the mold half 22 to have arcuate movement about an axis parallel to the path.

Figure 4:
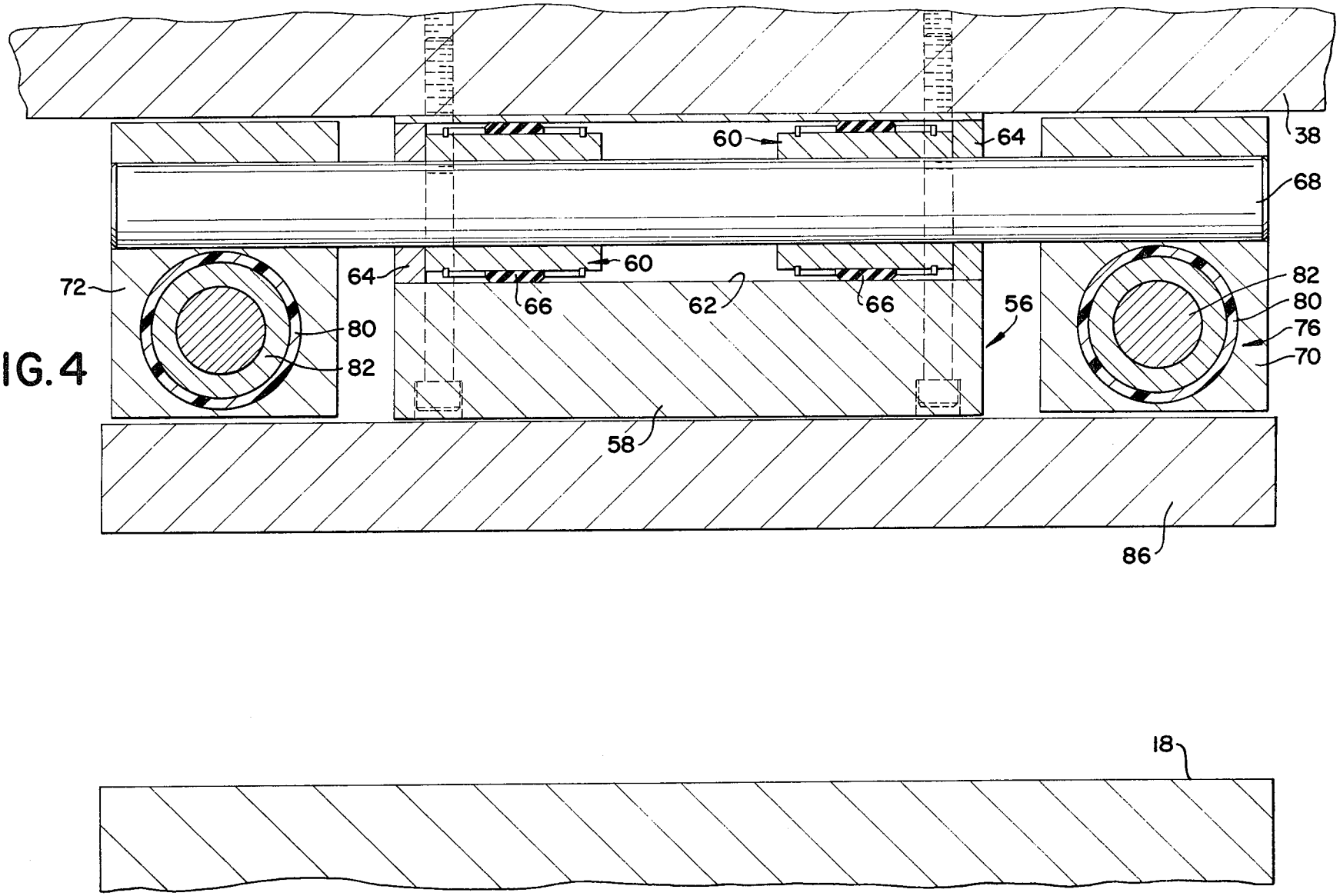
FIGS. 4 and 5 are cross-sectional views taken on lines 4—4 and 5—5, respectively, of FIG. 3.
Figure 5:
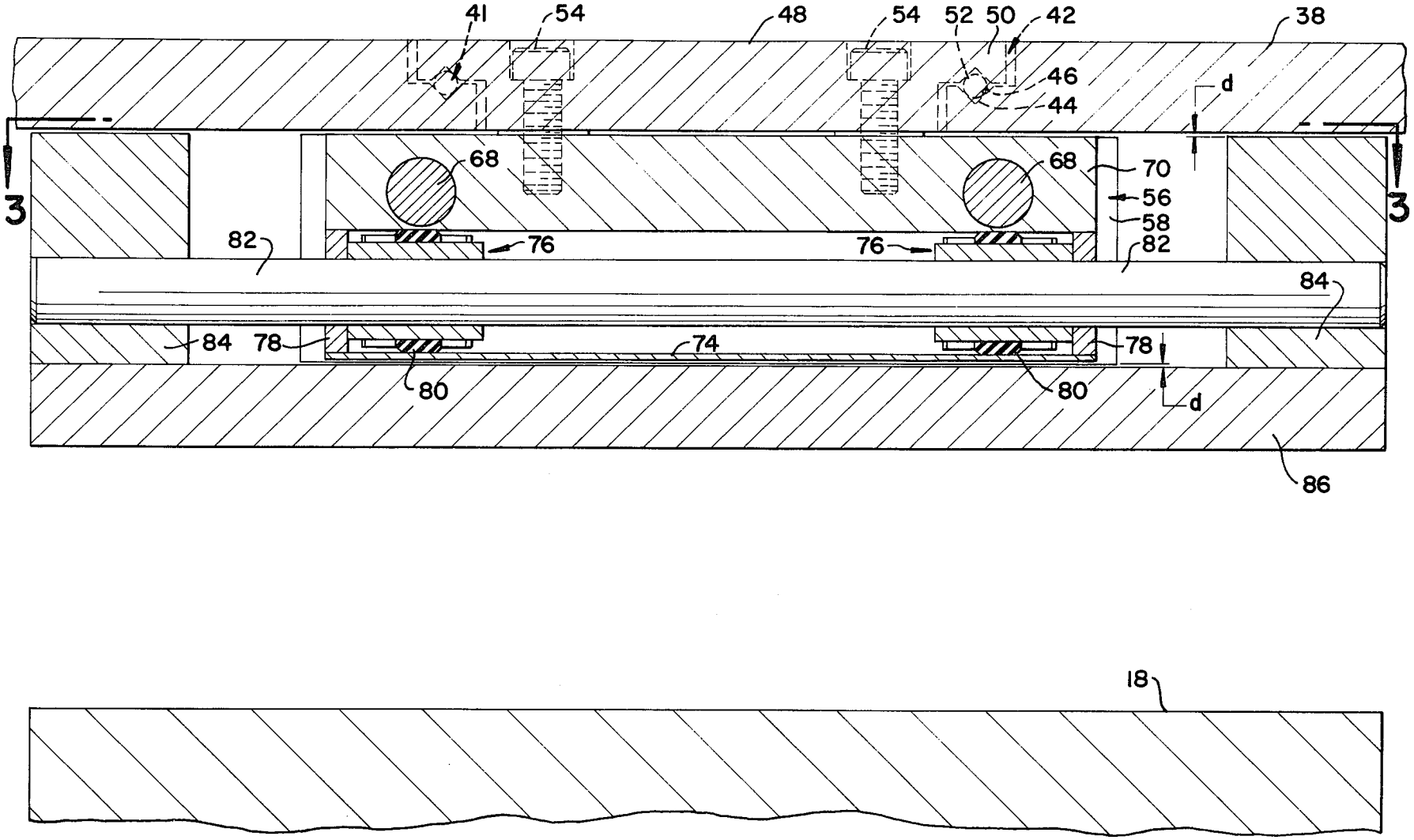
Figure 6:
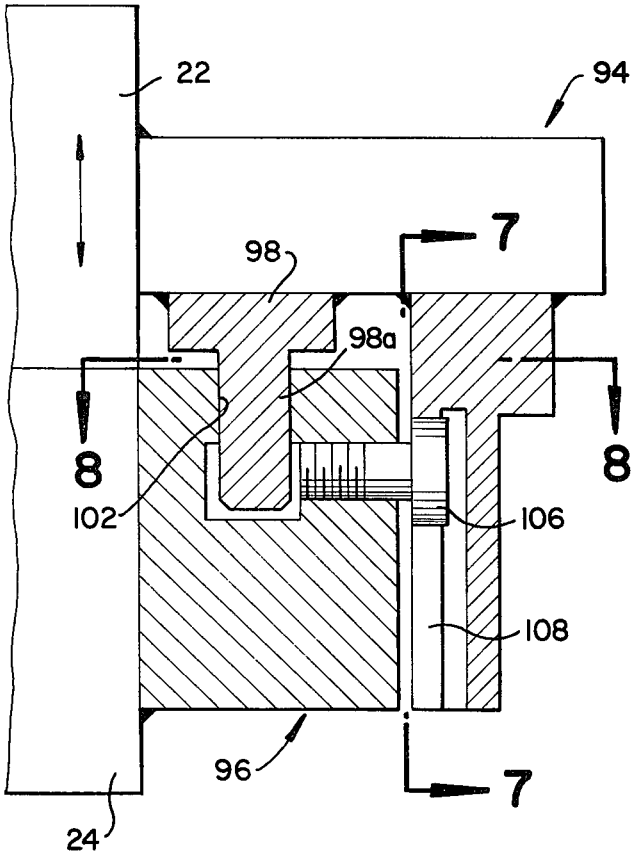
FIG. 6 is a partial, vertical cross-sectional through the cam assembly; and, FIGS. 7 and 8 are views taken generally on lines 7—7 and 8—8, respectively, of FIG. 6.

As shown in FIGs. 1, 4 and 5, assembly 36 comprises a first support plate member 38 which is positively connected to the upper platen 16 in any suitable manner. A bearing assembly 41 is carried in a circular opening 42 formed in plate 38 and having a radially inwardly-extending flange or shoulder 44. Shoulder 44 defines a bearing race 46. A circular plate member 48 with an outwardly-extending flange 50 is positioned in opening 42. As shown, plate member 48 is mounted for free rotation relative to member 38 by virtue of being carried on bearing balls 52 in race 46.

Suspended from circular plate member 48 by bolts 54 is an intermediate housing or support unit 56. Unit 56 comprises a rigid metal housing 58 having two pairs of linear ball bearing assemblies 60 mounted therein (see FIG. 4). As shown, each pair of assemblies 60 is mounted in a separate bore 62 and are retained therein by end plates 64. For reasons which will subsequently be explained, the assemblies 60 are resilient mounted in bores 62 by circumferentially-extending rubber sleeves 66. This permits the assemblies 60 to shift slightly in bores 62.

Extending freely through each pair of assemblies 60 are shafts 68. The ends of shafts 68 are fixed in slide members 70, 72. Slide members 70, 72 are identical in construction and only member 70 will be described in detail. As best shown in FIG. 5, member 70 includes a heavy rectangular body having a longitudinally-extending bore 74. A pair of spaced, linear ball bearing assemblies 76 are received in bore 74 and retained therein by end plates 78. Assemblies 76, like previously-mentioned assemblies 60, are resiliently mounted in bore 76 by a resilient, circumferential sleeve 80.

Figure 3:
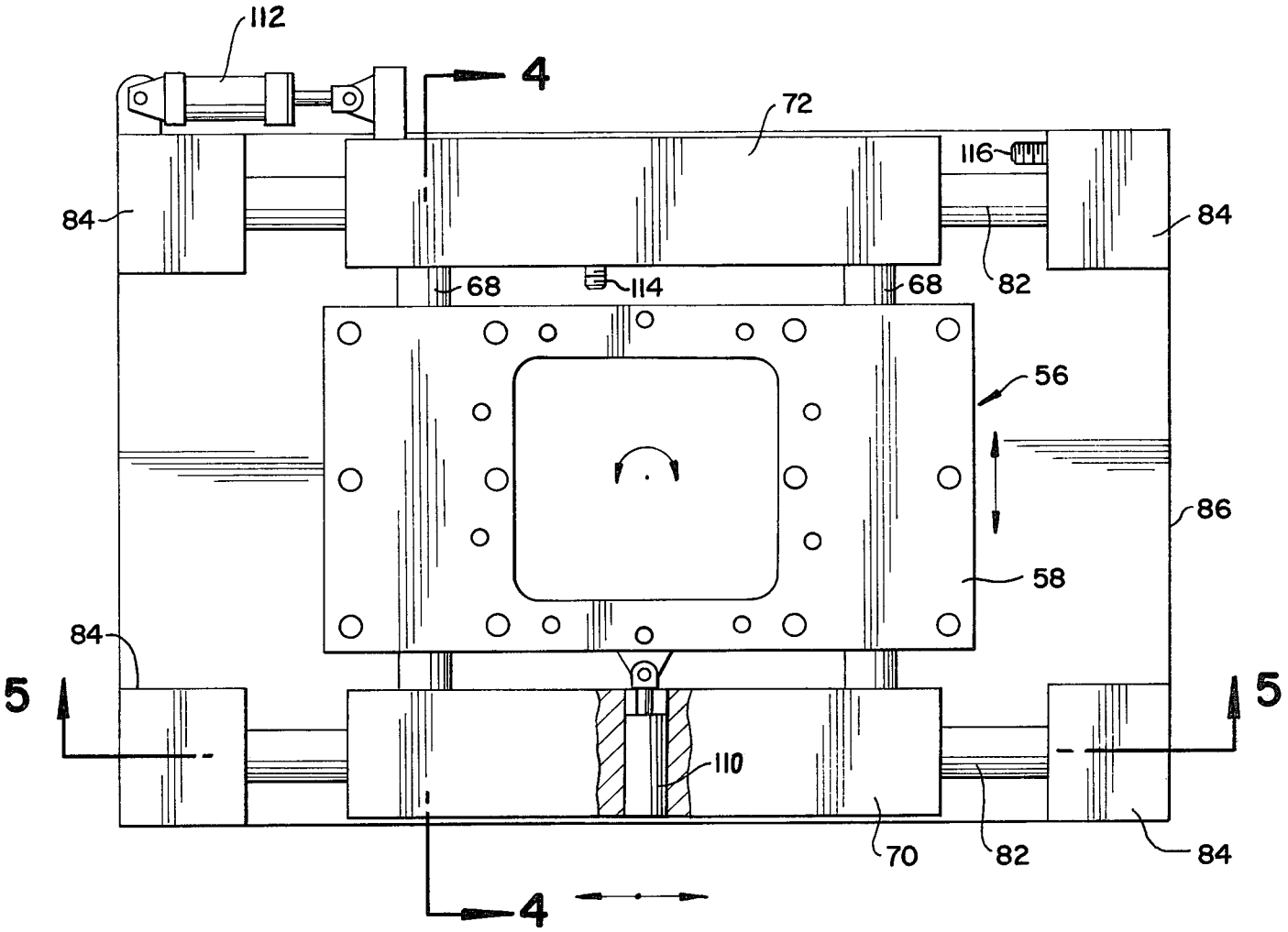
FIG. 3 is a cross-sectional view taken on line 3—3 of FIG. 1.

Extending through the bearing assemblies 76 of each slide member 70, 72 are shafts 88 (see FIGS. 3 and 4). As is apparent, this allows each of the mmebers 70, 72 to slide freely relatively to its respective shaft 82.

Positively connected to the opposite ends of each shaft 82 are rectangular support blocks 84. Support blocks 84 are in turn connected to and support a horizontal plate 86 which carries the upper mold half 22. It should be noted that the height of blocks 84 are such that the top surface of plate 86 is normally spaced a short distance d from the bottom of unit 56, while the top surface of each block 84 is spaced a corresponding distance d from the bottom surface of plate 38.

As is apparent, with the above components spaced in manner described, plate 86 and the upper mold half 22 are normally free to rotate about a vertical axis because of the bearing assembly 41. Additionally, as shown in FIG. 3, they are also free to shift transversely of the axis because of the shafts 68, 82 and the associated slide members.

It should be appreciated that when the upper platen 16 is actuated downwardly to bring the mold halves 22, 24 into clamping engagement, the resilient sleeves 80, 66 on bearing assemblies 76, 60, respectively, permit vertical shifting of the shafts 68, 82. This allows the top surfaces of blocks 84 to come into engagement with plate 38 (see FIG. 5). Likewise, the top and bottom surfaces of unit 56 directly engage the plates 38 and 86, respectively. Consequently, the required mold clamping forces are transmitted directly from the upper platen 16 to the upper mold half 22 without subjecting bearing assemblies 60, 76 to high loads.

With the upper mold half mounted from the upper platen in the manner described, it is possible to program or predetermine the movement of the upper mold half relative to the lower mold half during mold opening and closing. This permits the mold halves to be moved together along a non-linear path. The advantages of this can best be explained by reference to FIGS. 2 and 2A. As shown, the blade section can be molded by cooperating mold halves which have interengaging internal members 90, 92, respectively. Clearly, the mold halves cannot be separated or brought together by simple vertical reciprocation. However, by causing the upper mold half to move along the path indicated by dotted-line 94 in FIG. 2A, separation is possible.

As can be appreciated, many different types of control means could be provided for controlling the movement of the die halves during the opening and closing. In the subject embodiment, a mechanical cam assembly 94 is provided for this purpose. In particular, the cam assembly 94 includes a first unit 96 which is connected to or built into the lower die half and a pair of second units 98, 100. Unit 96 defines an arcuate groove 102 which has the same center as the part being formed, i.e., the part and the groove are concentric arcs. Unit 98 constitutes a radial guide and is connected to the upper die half. An arcuate portion 98a extends into groove 102 for sliding movement relative thereto. Consequently, in this particular embodiment the die halves are constrained during opening and closing movement to an arcuate path in horizontal planes (planes perpendicular to the vertical direction of opening and closing).

Figure 7:
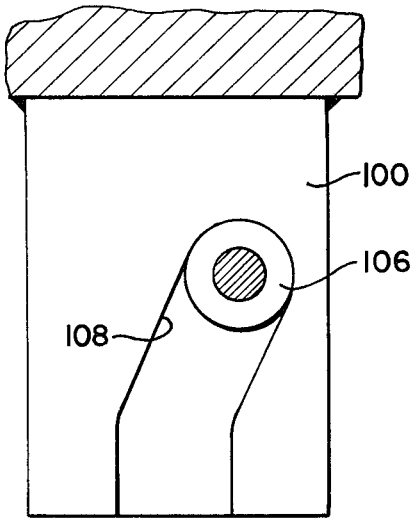
Figure 8:
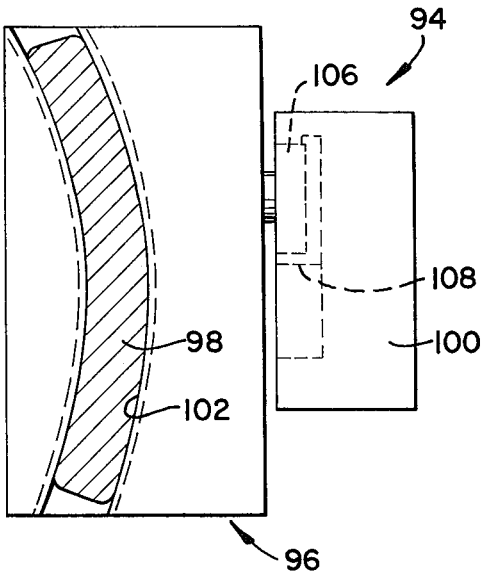

The rate of arcuate movement in horizontal planes relative to the vertical movement is controlled by a cam roller 106 which extends outwardly from unit 96 into a cam groove 108 formed in unit 100. FIG. 7 shows the configuration of groove 108.

As can be appreciated, during opening and closing movement of the die halves they are constrained by the cooperating cam units to cause a resultant movement corresponding to path 95 of FIG. 2A.

Although not required by the invention, movement of the die halves along the cam-controlled path during opening and closing movement is assisted by a pair of air cylinders 110 and 112 as shown in FIG. 3. The cylinders are also controlled to hold the upper die half in alignment and prevent undesired movement when it is in the full open position. As shown, adjustable stops 114 and 116 are provided to stop the horizontal movement at the desired point.

The invention has been described in great detail sufficient to enable one of ordinary skill in the art to make and use the same. Obviously, modifications and alterations of the preferred embodiment will occur to others upon a reading and understanding of the specification and it is my intention to include all such modifications and alterations as part of by invention insofar as they come within the scope of the appended claims.

What is claimed is:

1. Apparatus comprising:

a pair of mold-defining members cooperating to form a mold chamber;

a pair of platens for selectively moving said mold-defining members toward and away from one another along a path;

mounting means for connecting said mold-defining members to said platens, said mounting means including means for permitting at least one of said mold-defining members to move freely in directions transverse to said path and rotate about an axis parallel to said path; and, control means for causing said at least one mold-defining member to undergo a predetermined pattern of rotary and transverse movement during movement along said path.

2. The apparatus as defined in claim 1 wherein said control means comprise a cam surface mounted for movement with one of said mold-defining members and a cam follower mounted for movement with the other of said mold-defining members.

3. The appparatus as defined in claim 1 wherein said path extends generally vertically and said mounting means connects the upper mold-defining member to the upper platen.

4. The apparatus as defined in claim 1 wherein said mounting means includes a pair of guideway-forming assemblies extending perpendicular to one another and lying in planes perpendicular to said path.

5. The apparatus as defined in claim 4 wherein said guideway-forming assemblies comprise spaced pairs of rods.

6. Apparatus comprising:

an upper platen and a lower vertically aligned and mounted for vertical movement toward and away from one another;

a first mold half carried by said lower platen;

a second mold half carried by said upper platen;

mounting means connecting said second mold half to said upper platen; said mounting means including means for permitting free movement of said upper mold half in horizontal directions during relative movement of said platens; and, control means for producing a predetermined pattern of horizontal movement of said upper mold half during relative vertical movement of said platens.

7. The apparatus as defined in claim 6 wherein said mounting means further includes means for permitting said upper mold half to have free rotation about a vertical axis.

8. The apparatus as defined in claim 6 wherein said mounting means include a pair of spaced guideway-forming assemblies extending at right angles to one another and lying in horizontal planes.

9. The apparatus as defined in claim 7 wherein said control means include a cam member.

* * * * *